US008066052B2

(12) United States Patent
Blair

(10) Patent No.: US 8,066,052 B2
(45) Date of Patent: Nov. 29, 2011

(54) COOLED WALL THICKNESS CONTROL

(75) Inventor: Michael F. Blair, Manchester, CT (US)

(73) Assignee: United Technologies Corporation, Harford, CT (US)

( * ) Notice: Subject to any disclaimer, the term of this patent is extended or adjusted under 35 U.S.C. 154(b) by 1055 days.

(21) Appl. No.: 11/759,525

(22) Filed: Jun. 7, 2007

(65) Prior Publication Data

US 2010/0014102 A1 Jan. 21, 2010

(51) Int. Cl.
*B22C 9/04* (2006.01)
*B22C 9/10* (2006.01)

(52) U.S. Cl. ..... 164/44; 164/45; 164/369

(58) Field of Classification Search .... 356/237.1–237.3, 356/600–625; 164/369, 35, 5, 96, 370, 516, 164/44, 45; 416/97 R, 96 A, 97 A
See application file for complete search history.

(56) References Cited

U.S. PATENT DOCUMENTS

| | | | | |
|---|---|---|---|---|
| 5,090,866 | A * | 2/1992 | Blair | 415/115 |
| 5,296,308 | A | 3/1994 | Caccavale et al. | |
| 6,607,355 | B2 * | 8/2003 | Cunha et al. | 416/97 R |
| 6,637,500 | B2 | 10/2003 | Shah et al. | |
| 6,805,535 | B2 | 10/2004 | Tiemann | |
| 6,929,054 | B2 | 8/2005 | Beals et al. | |
| 7,014,424 | B2 | 3/2006 | Cunha et al. | |
| 7,134,475 | B2 | 11/2006 | Snyder et al. | |
| 7,144,220 | B2 * | 12/2006 | Marcin, Jr. | 416/97 A |
| 7,172,012 | B1 * | 2/2007 | Memmen | 164/45 |
| 7,185,695 | B1 * | 3/2007 | Santeler | 164/44 |
| 7,207,374 | B2 * | 4/2007 | Persky et al. | 164/369 |
| 7,216,689 | B2 | 5/2007 | Verner et al. | |
| 7,306,024 | B2 | 12/2007 | Beals et al. | |
| 7,322,795 | B2 * | 1/2008 | Luczak et al. | 416/96 A |
| 7,686,068 | B2 * | 3/2010 | Tholen et al. | 164/369 |
| 2006/0118262 | A1 | 6/2006 | Beals et al. | |
| 2006/0239819 | A1 | 10/2006 | Albert et al. | |
| 2007/0044934 | A1 | 3/2007 | Santeler | |

FOREIGN PATENT DOCUMENTS

EP 1923153 A1 5/2008

OTHER PUBLICATIONS

EP Office Action for European Patent Application No. 08251980.2, dated Apr. 29, 2010.

* cited by examiner

*Primary Examiner* — Sang Nguyen
(74) *Attorney, Agent, or Firm* — Bachman & LaPointe, P.C.

(57) ABSTRACT

A casting includes a wall thickness check feature for measuring thickness of a wall second aside an in-wall cooling passageway. The thickness is determined by observing the existence and/or size of an opening formed by the feature. The casting is cast from a pattern including portions forming the feature. To manufacture the pattern, a pattern-forming die is assembled with a ceramic feedcore and a refractory metal core (RMC). The assembling leaves an inlet portion of the RMC engaged to the ceramic feedcore and leaves an outlet portion of the RMC engaged to the die. A pattern-forming material is molded in the die at least partially over the ceramic feedcore and RMC. The die is disengaged from the pattern-forming material. The assembling engages a stepped projection of the RMC with a mating surface of the die.

20 Claims, 7 Drawing Sheets

COOLED WALL THICKNESS CONTROL

BACKGROUND

The disclosure relates to gas turbine engines. More particularly, the disclosure relates to casting of cooled airfoils for gas turbine engine blades and vanes.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al., U.S. Pat. No. 6,929,054 of Beals et al., U.S. Pat. No. 7,014,424 of Cunha et al., U.S. Pat. No. 7,134,475 of Snyder et al., U.S. Pat. No. 7,216,689 of Verner et al., and U.S. Patent Publication Nos. 20060239819 of Albert et al. and 20070044934 of Santeler et al. (the disclosures of which are incorporated by reference herein as if set forth at length) disclose use of ceramic and refractory metal core combinations.

SUMMARY

One aspect of the disclosure involves a method for inspecting a part having an in-wall cooling passageway. The in-wall cooling passageway separates an interior wall section from an exterior wall section. A reference location along the in-wall cooling passageway is observed. A size of an aperture at the reference location is determined. Based upon the determined size, a condition of the associated wall section is determined.

The method may be performed sequentially on a plurality of said parts. The parts may be a plurality of cooled airfoils, each having a pressure side and a suction side. The method may be performed for both the wall sections on each part. The method may be performed for a plurality of the in-wall passageways on each part. The method may be performed for multiple walls on each part.

Another aspect of the disclosure involves a method for manufacturing a casting pattern. A pattern-forming die is assembled with a ceramic feedcore and a refractory metal core (RMC). The assembling leaves an inlet portion of the RMC engaged to the ceramic feedcore and leaves an outlet portion of the RMC engaged to the die. A pattern-forming material is molded in the die at least partially over the ceramic feedcore and RMC. The die is disengaged from the pattern-forming material. The assembling engages a stepped projection of the RMC with a mating surface of the die. The stepped projection may be intermediate the inlet and outlet portions.

Another aspect of the disclosure involves a casting pattern. The pattern includes a ceramic feedcore, a refractory metal core (RMC) mated to the ceramic feedcore, and a sacrificial pattern material is molded at least partially over the ceramic feedcore and RMC. The sacrificial pattern material defines a pressure side and a suction side. The RMC has an inlet portion mated to the ceramic feedcore and an outlet portion protruding from the sacrificial pattern material. A stepped intermediate portion protrudes from the main body portion.

Another aspect of the disclosure involves a casting core assembly comprising a ceramic feedcore and a refractory metal core (RMC). The RMC is mated to the ceramic feedcore and comprises means for providing a wall thickness check feature in a casting cast over the core.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
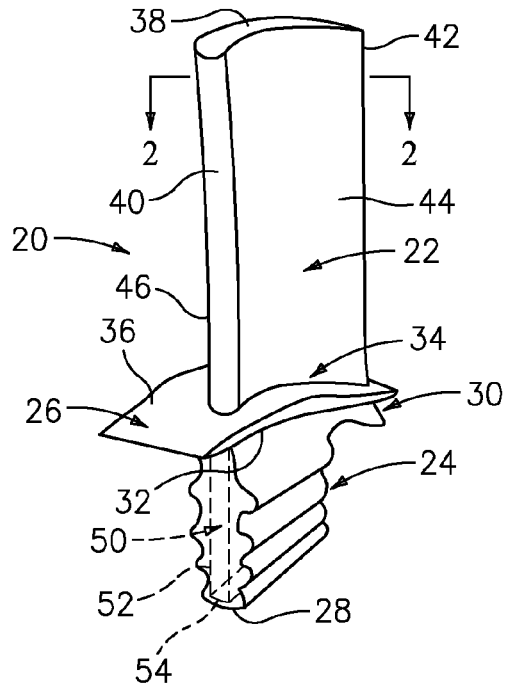
FIG. 1 is a view of a gas turbine engine blade.

FIG. 1 shows a gas turbine engine blade 20 having an airfoil 22, an attachment root 24, and a platform 26. The exemplary airfoil, root, and platform may be formed as a unitary casting (e.g., of a nickel- or cobalt-based superalloy). The exemplary root 24 extends from an inboard end 28 to an outboard end 30 at an underside 32 of the platform 26. The root 24 has a convoluted so-called fir tree profile for attaching to a complementary slot (not shown) in a disk.

The airfoil 22 extends from an inboard end 34 at an outboard surface 36 of the platform to an outboard end 38. The exemplary outboard end 38 is a free distal tip. Alternative blades may have outboard shrouds. Alternative airfoils may be implemented in fixed vanes.

The airfoil 22 has an exterior/external aerodynamic surface extending from a leading edge 40 to a trailing edge 42. The airfoil has a pressure side (surface) 44 and a suction side (surface) 46.

Figure 2:
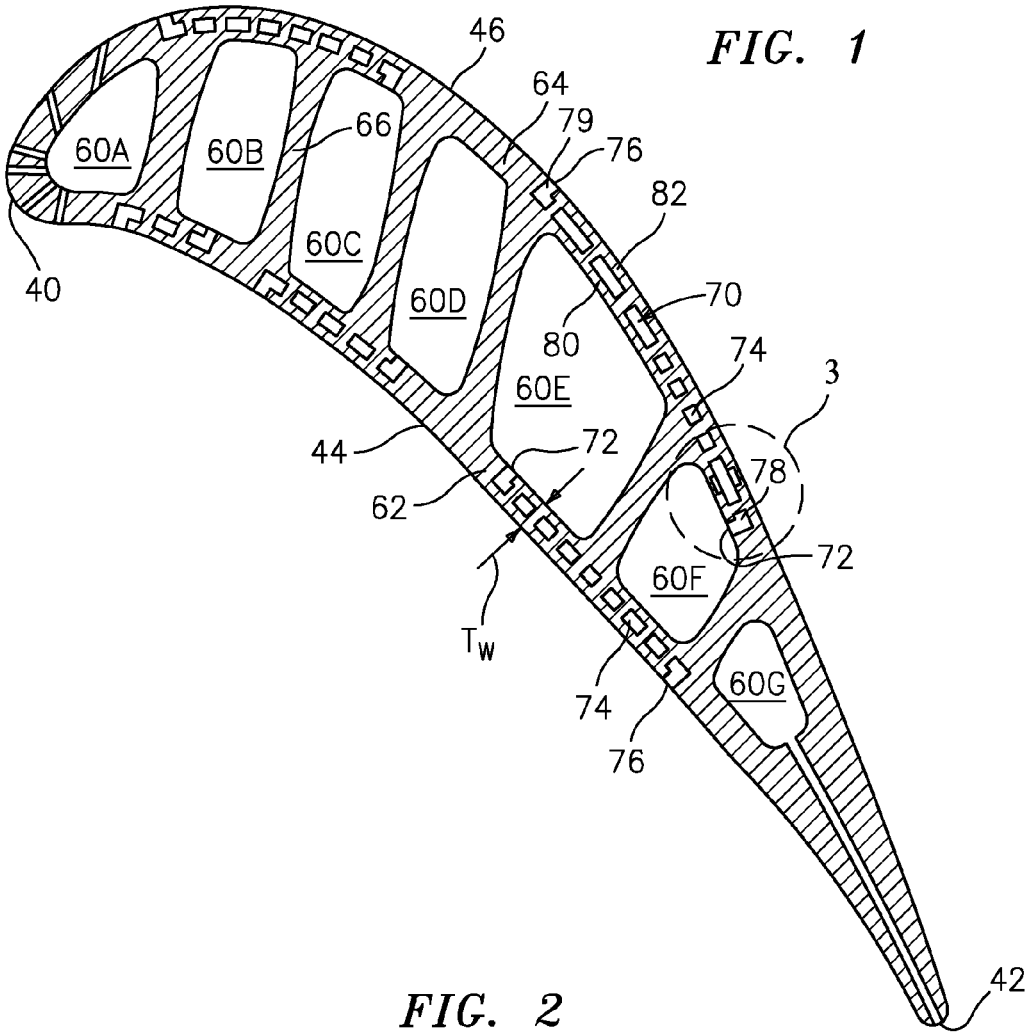
FIG. 2 is a cross-sectional view of the blade of FIG. 1, taken along line 2-2.

The airfoil 22 is cooled via a cooling passageway system 50. The passageway system 50 includes one or more trunks 52 extending from one or more inlets 54 in the root 24. The exemplary network 50 includes a plurality of span-wise passageway legs (e.g., feed passageways) 60A-G (FIG. 2). The exemplary passageway legs leave a pressure side wall 62 and a suction side wall 64. The pressure side wall 62 and suction side wall 64 may be connected by a number of dividing walls 66 which separate adjacent pairs of the feed passageway legs. The feed passageway legs may be, in one or more combinations, separate passageways or legs of one or more common passageways connected by turns or other means.

One or both of the pressure side wall 62 and the suction side wall 64 may be cooled via one or more wall cooling passageways (in-wall passageways) 70. The exemplary wall cooling passageways include inlets (ports) 72 at one or more of the feed passageway legs, a slot-like main section 74 extending in the span-wise and stream-wise directions, and outlets (ports) 76 to the associated pressure side 44 or suction side 46. Respective inlet and outlet terminal portions 78 and 79 extend between the inlets and outlets on the one hand and the main section 74 on the other hand.

Figure 3:
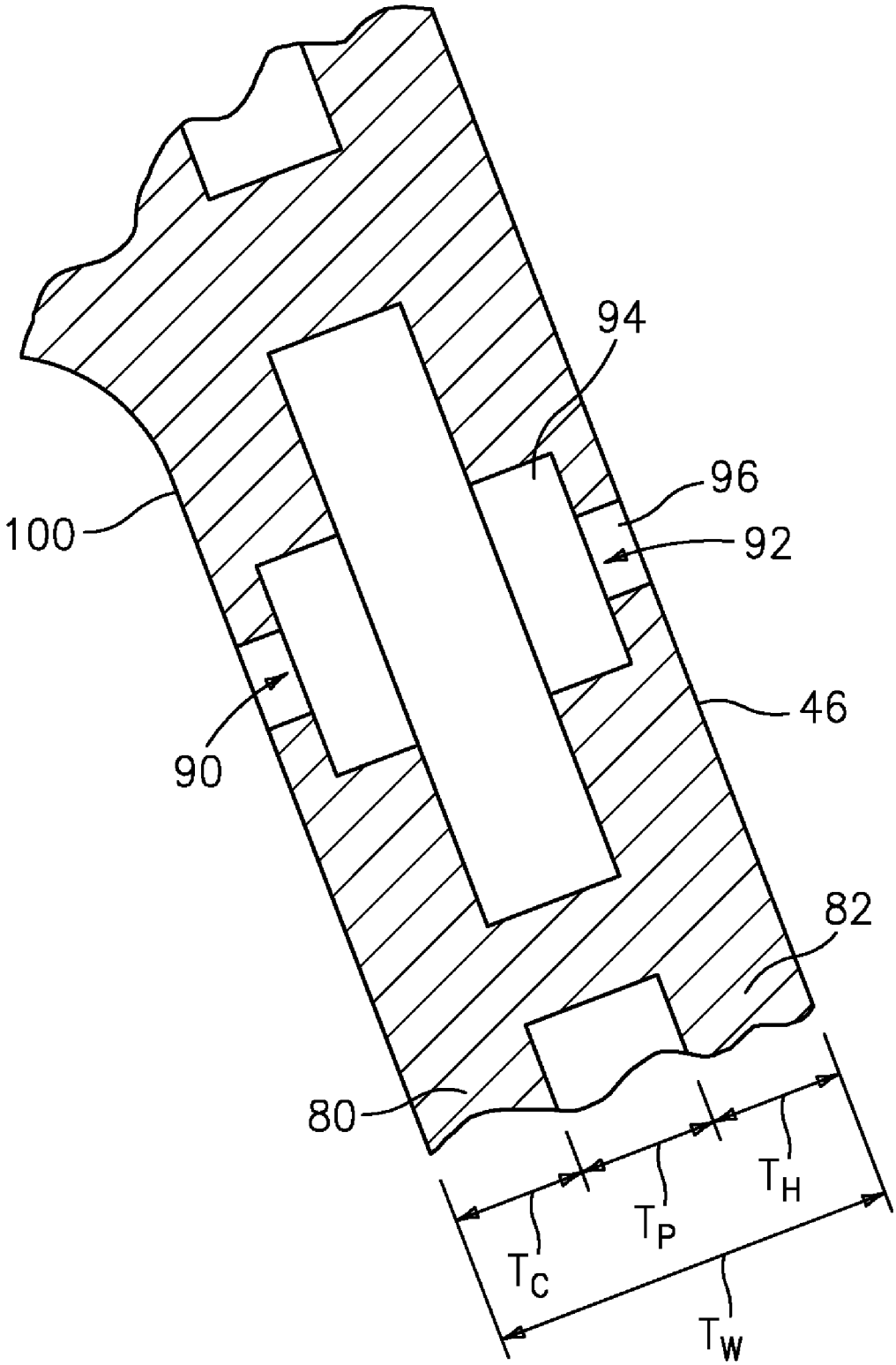
FIG. 3 is an enlarged view of the blade of FIG. 2.

Such wall cooling passageways 70 may be cast using refractory metal cores (RMCs) as are known or may be developed. Each of the wall cooling passageways 70 separates an interior section/portion 80 of its associated pressure side wall 62 or suction side wall 64 from an exterior section/portion 82 of that wall. With the interior section 80 typically exposed directly to the cool cooling air flowing through the passageway legs, the section 80 is typically designated the "cooled wall". The exterior section 82 is typically exposed to hot gas of the engine core flowpath and is typically designated the "hot wall". An overall wall thickness is shown as $T_W$. $T_W$ (FIG. 3) is equal to the sum of the cooled wall thickness $T_C$, the wall cooling passageway thickness $T_P$, and the hot wall thickness $T_H$. $T_W$, $T_C$, $T_P$, and $T_H$ may vary in relative or absolute terms with the particular location along the airfoil.

It is desired to visually determine wall condition (e.g., of the pressure side wall and/or suction side wall). More particularly it is desired to verify that the wall thicknesses $T_C$ and $T_H$ are within specified limits. For example, erosion during use may reduce the thickness $T_H$ below an acceptable minimum value. Additionally, or alternatively, as-manufactured (e.g., as-cast) thickness may be verified for $T_C$, $T_H$, or both.

Exemplary means for providing the thickness check include an extension (e.g., a branch or alcove) 90 of the wall cooling passageway into the interior wall section and another extension 92 into the exterior wall section. Exemplary extensions are from the main section 74 of the wall cooling passageway.

Some implementations may not include both extensions 90 and 92.

Exemplary extensions 90 and 92 are nominally through-extensions, penetrating through the associated wall section 62 or 64. The term "nominally" contemplates the possibility that they may be through-extensions only in a normal situation (e.g., when the thickness is not excessive). In such a situation, the absence of penetration would indicate an excessive wall thickness. The exemplary extensions have stepped cross-section (e.g., a proximal portion 94 of the extension has a larger cross-section in at least one dimension than does a distal portion 96). Normally, the distal portion 96 will be open to the associated surface (i.e., exterior surface (pressure side 44 or suction side 46) or an interior surface 100). Thus, normally, observation of that surface (at a reference location where the extension is) will yield a view of an aperture characterized by the cross-section of the distal portion 96. If the distal portion 96 is effectively worn away or if a manufacturing defect similarly reduces the thickness of the wall section, the inspection will show in the cross-section of the proximal portion and will, thereby, indicate an insufficient thickness thereby causing part rejection (e.g., leading to disposal or restoration).

Figure 4:
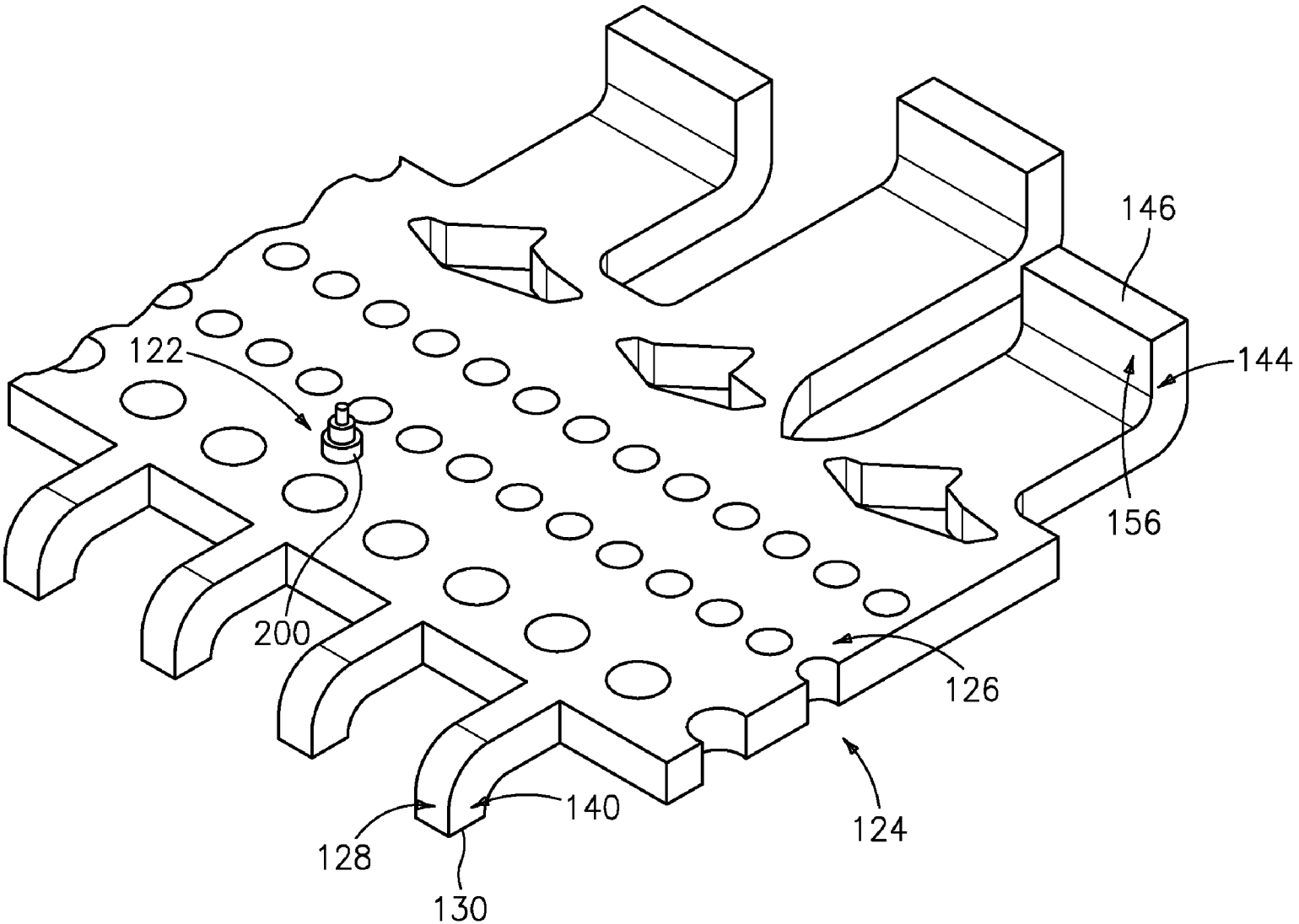
FIG. 4 is a view of a refractory metal core for casting a passageway of the blade of FIG. 1.
Figure 5:
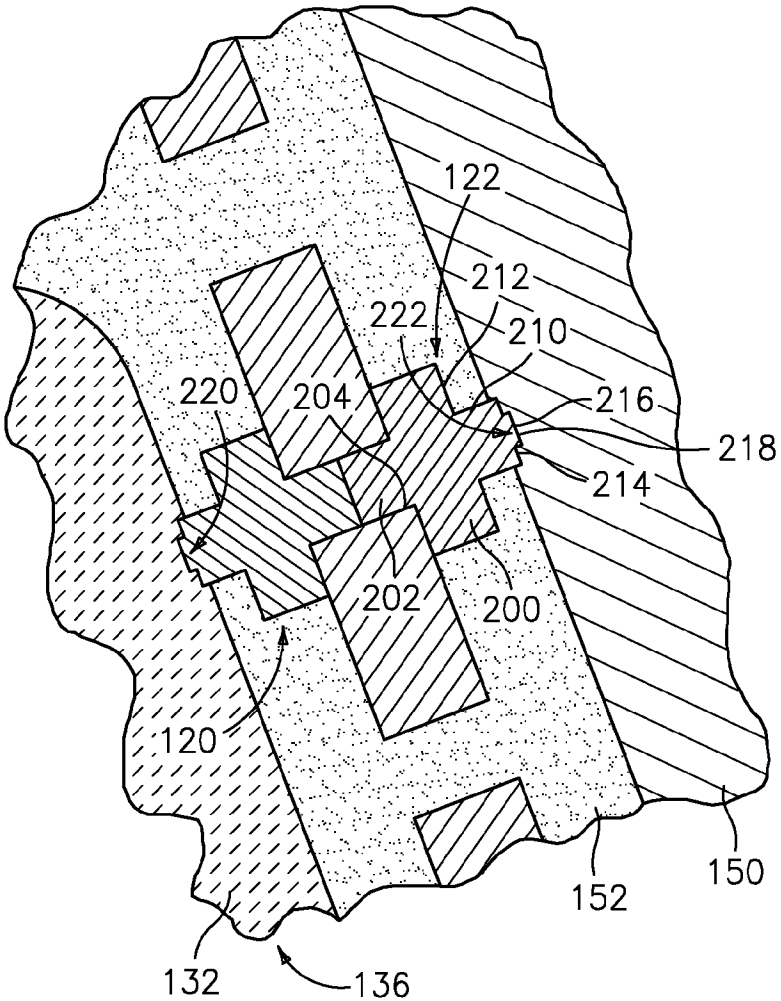
FIG. 5 is a sectional view of a pattern in a pattern forming die.

The extensions 90 and 92 may be cast by associated projections 120 and 122 (FIGS. 4 and 5) from the refractory metal core (RMC) 124. An exemplary casting process is an investment casting process wherein the RMCs are assembled to a feedcore (e.g., a ceramic feedcore) in a pattern-forming die. A sacrificial pattern material (e.g., a wax) is molded in the die at least partially over the feedcore and RMCs to define a pressure side and a suction side of the pattern. The die elements are separated and the pattern removed from the die. The pattern may be shelled (e.g., via a multi-stage stuccoing process). The sacrificial pattern material may be removed (e.g., in a dewaxing) to leave a void for casting the blade or vane. Molten metal is introduced to the void and cooled to solidify. The shell may be removed (e.g., via mechanical means). The core may be removed (e.g., via chemical means) to leave a raw casting. The casting may be machined, treated, and/or coated.

Figure 6:
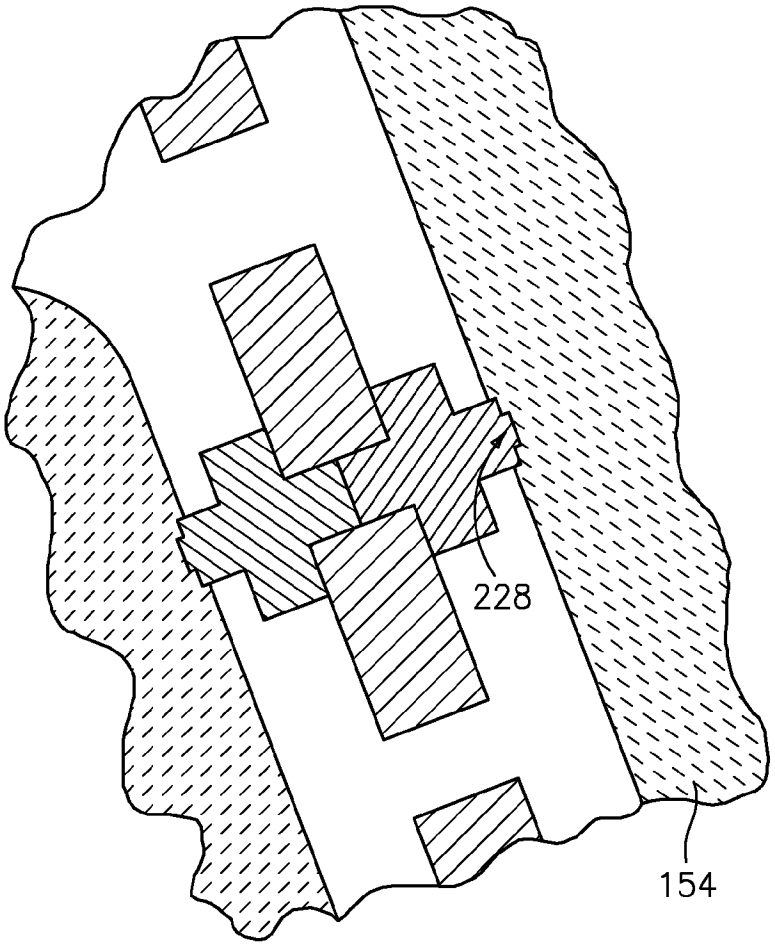
FIG. 6 is a sectional view of a shell formed from the pattern of FIG. 5.

An exemplary RMC 124 for forming the wall cooling passageways has a main body portion 126 which may be flat or off-flat to conform to the shape of the associated side wall. An inlet end portion 128 (FIG. 4) may project transverse to the main body portion 126. A distal end 130 of the inlet end portion may mate with an associated leg 132 of the feedcore 136. A proximal portion 140 of the inlet end portion casts inlet apertures/ports 72 to the wall cooling passageway. Similarly, an outlet end portion 144 may project transverse to the main body portion opposite the inlet end portion (e.g., at a downstream end of the main body portion). A distal end 146 of the outlet end portion may be positioned to be received by a die element 150 of the pattern-forming die to project from the sacrificial pattern material 152 and, in turn, become embedded in the shell 154 (FIG. 6). A proximal portion 156 (FIG. 6) of the outlet end portion casts outlet holes/ports 76 to the associated pressure side or suction side.

Exemplary extensions 90 and 92 are formed as streamwise intermediate portions of the RMC (i.e., intermediate the inlet and outlet ends of the main section 74).

The exemplary RMC is formed from sheetstock (e.g., by cutting and shaping followed by coating). A first face of the sheet forms an outboard face of the main body portion 126 and the second face of the sheet forms the inboard face of the main body portion 126.

An exemplary manufacturing process involves separately forming the projections 120 and 122 and then attaching them to the remainder of the RMC. This, for example, may allow greater choice of cross-sectional shape for the projections. For example, the projections may be formed as stepped right circular cylinders. A large diameter/cross-section base portion 200 of the projection could be secured at the RMC main body portion such as by a mechanical interfit (e.g., a depending projection 202 of the cylinder interfitting with an aperture 204 of the main body portion) and/or a metallurgical attachment (e.g., weld, braze, and the like). After the attachment, the RMC may be coated (if at all).

In the exemplary stepped right circular cylindrical projections, the base portion 200 casts the extension proximal portion 94. A projection intermediate portion 210 casts the distal portion 96. A shoulder 212 separates the intermediate portion 210 from the base portion 200. The intermediate portion 210 has a distal end 214. The exemplary distal end 214 is a shoulder separating the intermediate portion 210 from a distal portion 216. The distal portion 216 extends to an end 218.

The projections mate with associated compartments 220 and 222 respectively in the feedcore 136 and die element 150. In the exemplary implementation, these compartments 220 and 222 are stepped with a base portion capturing the projection distal portion 216 and an outer portion capturing an end of the projection intermediate portion 210. For the outer/exterior projection 122, the distal portion 216 and the end of the intermediate portion 210 which were received in the die compartment 222 protrude from the sacrificial pattern material after molding and become embedded in a corresponding compartment 228 formed in the shell 154.

Figure 7:
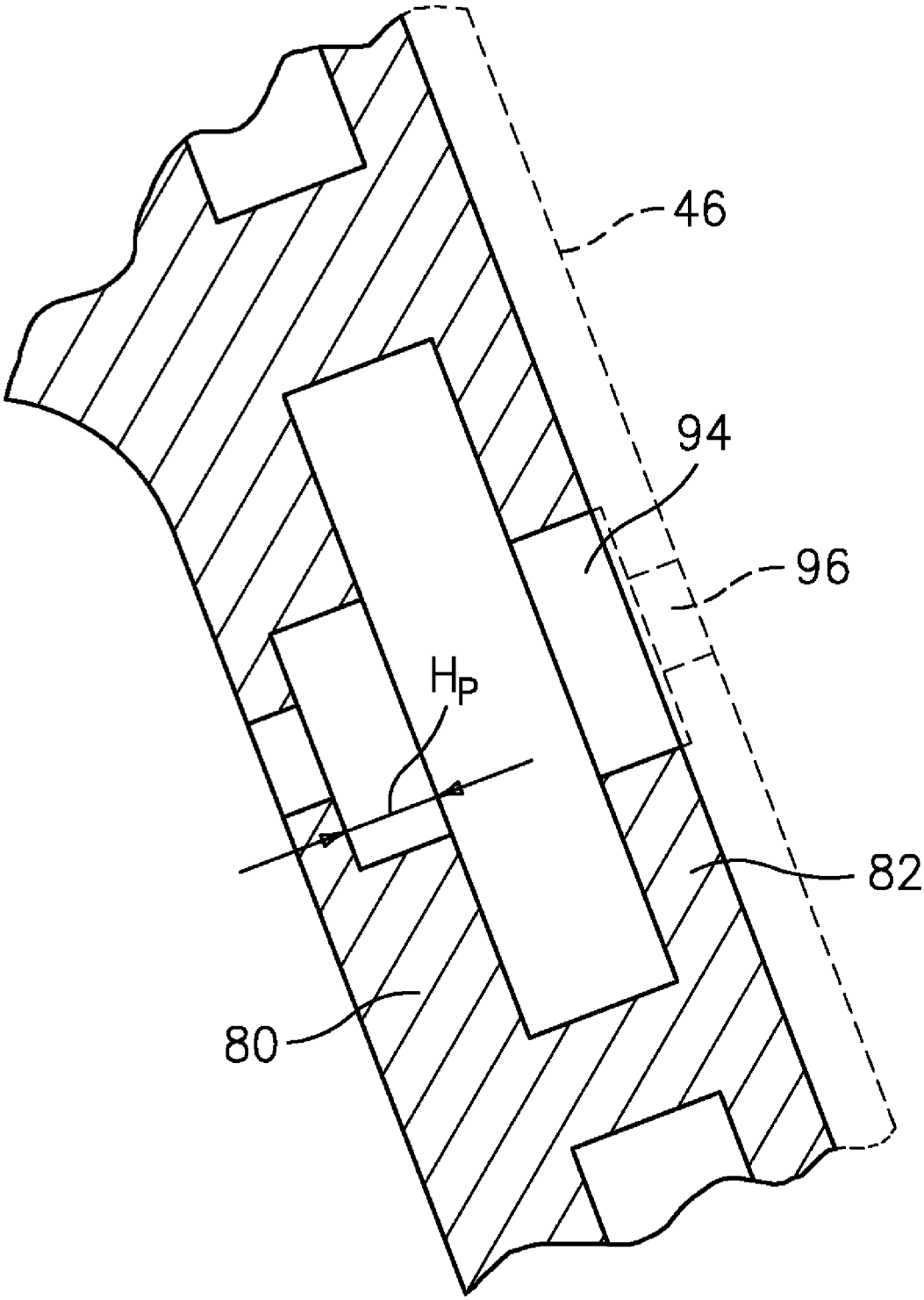
FIG. 7 is a sectional view of a first worn or defective airfoil.

FIG. 7 shows a first situation wherein the hot wall 82 is excessively thin while the cooled wall 80 is of acceptable (e.g., nominal/normal) thickness. For example, the hot wall 82 may have been cast with insufficient thickness. Alternatively, the hot wall may have eroded along the exterior surface (e.g., the suction side 46 in FIG. 7) sufficiently to get down below the distal portion 96. In such a situation, the larger size of the proximal portion 94 will be visible from external inspection. Accordingly, the proximal portion may be formed with a height $H_P$ that represents the minimum tolerable thickness ($T_C$ or $T_H$) of the corresponding section 80 or 82. Although shown of equal size, $H_P$ and other dimensions may differ between the two projections.

Figure 8:
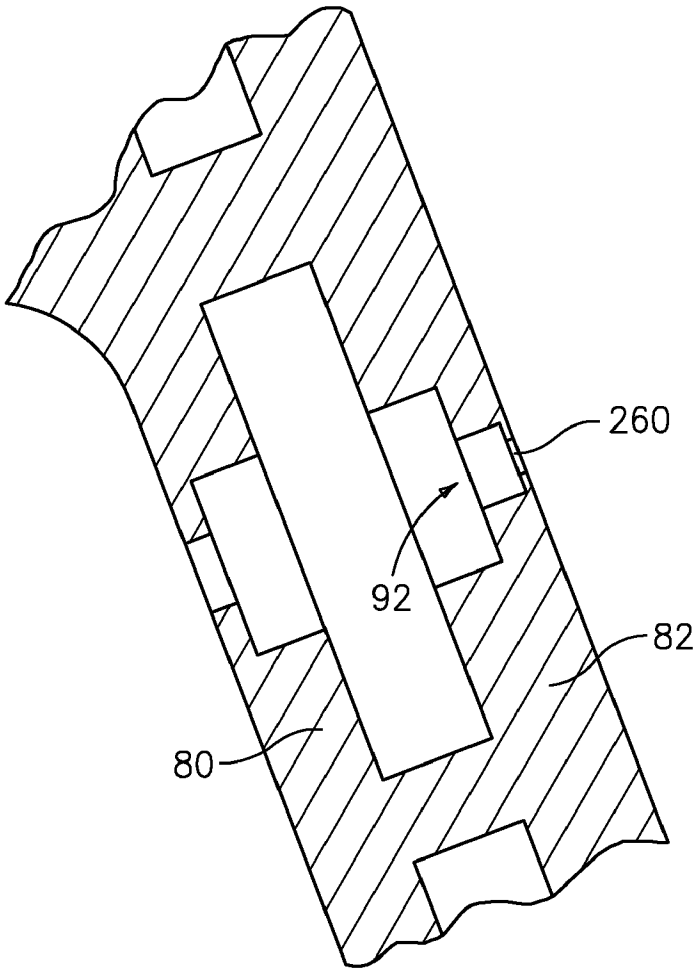
FIG. 8 is a sectional view of a second defective airfoil.

FIG. 8 shows a situation in which the hot wall 82 is excessively thick. An end portion 260 of the associated extension 92 has been cast by the projection distal portion 216, leaving a particularly small cross-section opening/aperture which may be distinguished from the cross-section of the normal extension distal portion 96. The projection intermediate portion 210 may have a thickness such that the overall projection height at the intermediate portion distal end 214 corresponds to the maximum acceptable associated wall thickness $T_H$ or $T_C$.

Figure 9:
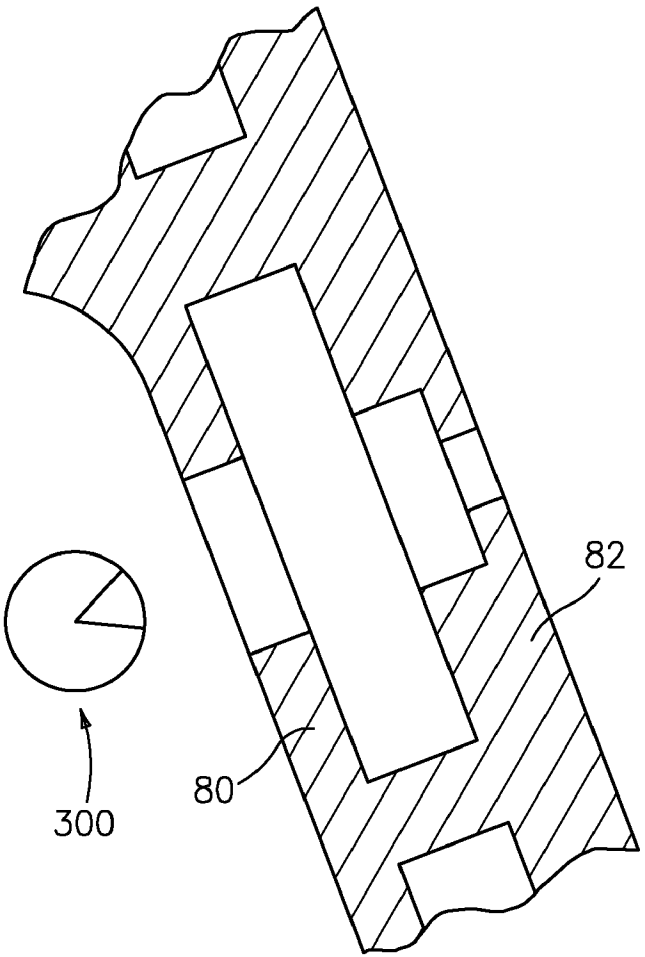
FIG. 9 is a view of a third defective airfoil.

FIG. 9 shows a situation where the cooled wall 80 is excessively thin. This may be observed via use of an endoscope 300 (e.g., inserted through an inlet 54 and associated feed passageway).

Figure 10:
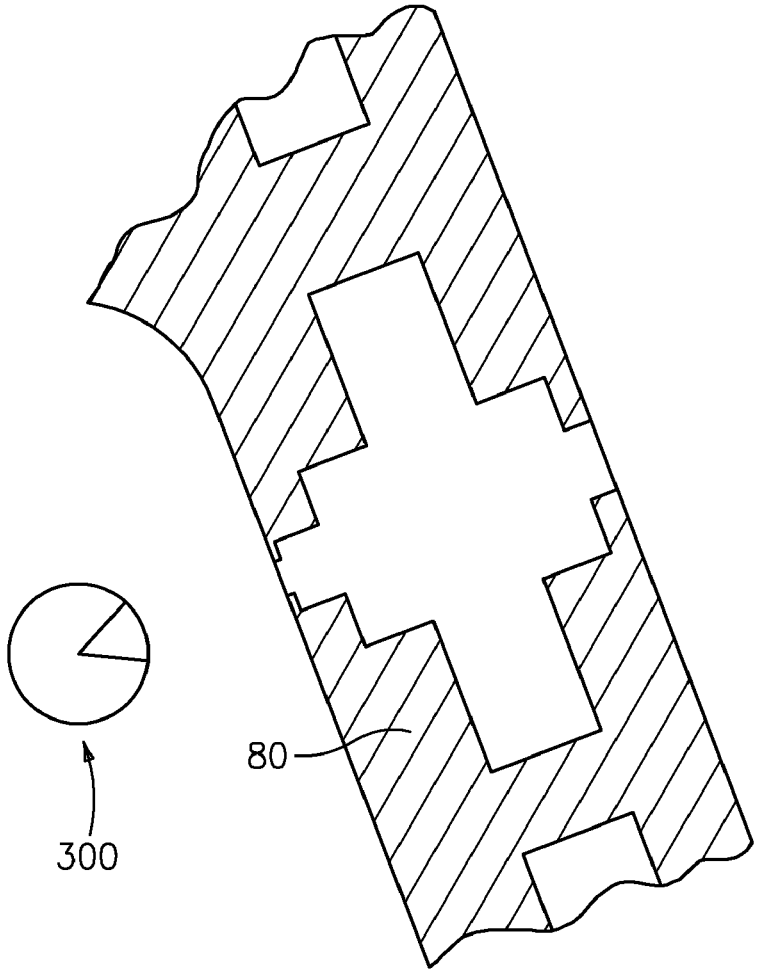
FIG. 10 is a sectional view of a fourth defective airfoil.

FIG. 10 shows a situation wherein the cooled wall 80 is excessively thick.

In situations where the extensions are provided along both the interior wall section and the exterior wall section, the extensions may be distributed so as to eliminate or limit the chances for leakage flow (e.g., a leakage flow from a feed passageway through the interior wall extension and out the exterior wall extension). In one example, there are multiple wall cooling passageways. One or more of the wall cooling passageways have only the interior wall extension 90 while one or more others of the wall cooling passageways have only the exterior wall extension 92. In situations where a given wall cooling passageway has both one or more interior wall extensions 90 and one or more exterior wall extensions 92, the respective extensions may be offset from each other in spanwise and/or stream-wise directions to limit leakage flow.

Figure 11:
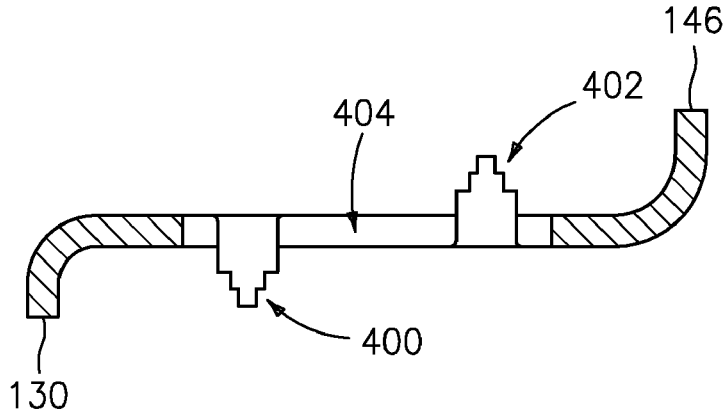
FIG. 11 is a sectional view of an alternate refractory metal core.

In an alternative method of manufacture, the projections may be formed in the same process from the same sheet. For example, the projections 400 and 402 (FIG. 11) may be cut (e.g., laser cut) to have a stepped cross-section (stepped in only one direction) while the sheet is flat. The projections may then be bent out of local coplanarity to the main body portion. In the FIG. 11 example, the projections 400 and 402 are formed along an aperture 404 with the RMC main body portion. This allows the projections to be unitarily formed with the adjacent portions of the RMC (e.g., unitarily formed with a by-mass majority portion of the RMC or essentially a remainder of the RMC).

The foregoing principles may be applied in the reengineering of an existing core/process/part configuration. For example, the projections could be added to an existing core configuration for making a drop-in replacement for an existing airfoil. However, the principles may be applied in a clean sheet engineering or a more comprehensive reengineering.

One or more embodiments have been described. Nevertheless, it will be understood that various modifications may be made. For example, when implemented in a reengineering of a given part configuration, details of the existing configuration and/or details of existing manufacturing equipment may influence details of any particular implementation. Accordingly, other embodiments are within the scope of the following claims.

What is claimed is:

1. A casting pattern comprising:

a ceramic feedcore;

a refractory metal core mated to the ceramic feedcore; and a sacrificial pattern material at least partially over the ceramic feedcore and refractory metal core, wherein: the refractory metal core has an inlet portion mated to the ceramic feedcore and an outlet portion protruding from the sacrificial pattern material, a main body portion extending between the inlet and outlet portions and a protruding stepped portion;

the stepped portion protrudes from the main body portion intermediate the inlet portion and the outlet portion;

the stepped portion projects from the main body portion transverse to the main body portion; and the stepped portion has a distal portion extending to an end and separate from distal ends of the inlet portion and outlet portion.

2. The pattern of claim 1 being an airfoil pattern wherein:

the sacrificial pattern material defines a pressure side and a suction side.

3. The airfoil pattern of claim 2 wherein:

the refractory metal core is along the pressure side of the sacrificial pattern material.

4. The pattern of claim 1 wherein:

a distal end of the stepped portion protrudes from the sacrificial pattern material.

5. The pattern of claim 1 wherein:

a distal end of the stepped portion is flush with an outer surface of the sacrificial pattern material.

6. The pattern of claim 1 wherein:

a first said stepped portion protrudes away from the ceramic feedcore; and a second said stepped portion protrudes toward the ceramic feedcore.

7. The casting pattern of claim 1 wherein:

the refractory metal core comprises a cut and bent sheet.

8. The casting pattern of claim 7 wherein:

the stepped portion comprises a proximal shoulder and a distal shoulder.

9. The casting pattern of claim 7 wherein:

the stepped portion extends from a face of the sheet.

10. The casting pattern of claim 7 wherein:

the inlet portion and outlet portion are formed as portions of said sheet and the protruding stepped portion is a separate piece attached to said sheet.

11. A method for manufacturing a casting pattern of claim 1, the method comprising:

assembling a pattern-forming die with said ceramic feedcore and said refractory metal core, the assembling leaving said inlet portion of the refractory metal core engaged to the ceramic feedcore and leaving said outlet portion of the refractory metal core engaged to the die;

molding sacrificial pattern material in the die at least partially over the ceramic feedcore and refractory metal core; and disengaging the die from the sacrificial pattern material, wherein the assembling engages said stepped portion of the refractory metal core, with a mating surface of the die.

12. The method of claim 11 wherein:

the stepped portion is intermediate the inlet and outlet portions.

13. The method of claim 11 wherein:

the assembling further engages a second stepped portion of the refractory metal core, intermediate the inlet and outlet portions, with the ceramic feedcore.

14. A method comprising:

manufacturing according to claim 11 a casting pattern;

shelling the pattern;

removing the pattern-forming material so as to leave the ceramic feedcore and refractory metal core partially embedded in the shell;

introducing molten metal to the shell; and removing the shell, the ceramic feedcore, and the refractory metal core.

15. A casting pattern comprising:

a ceramic feedcore;

a refractory metal core mated to the ceramic feedcore; and a sacrificial pattern material at least partially over the ceramic feedcore and refractory metal core, wherein:

the refractory metal core has an inlet portion mated to the ceramic feedcore and an outlet portion protruding from the sacrificial pattern material, a main body portion extending between the inlet and outlet portions and a protruding stepped portion;

a first said stepped portion protrudes away from the ceramic feedcore; and a second said stepped portion protrudes toward the ceramic feedcore.

16. The pattern of claim 15 wherein:

the first said stepped portion and the second said stepped portion are, respectively, separate pieces from the main body portion.

17. The pattern of claim 16 wherein:

the main body portion comprises a cut and bent sheet.

18. The pattern of claim 15 wherein:

the second said stepped portion contacts the ceramic feedcore.

19. The pattern of claim 18 wherein:

the first said stepped portion protrudes from the sacrificial pattern material.

20. A method for manufacturing a casting pattern of claim 15, the method comprising:

assembling a pattern-forming die with said ceramic feedcore and said refractory metal core, the assembling leaving said inlet portion of the refractory metal core engaged to the ceramic feedcore and leaving said outlet portion of the refractory metal core engaged to the die;

molding sacrificial pattern material in the die at least partially over the ceramic feedcore and refractory metal core; and disengaging the die from the sacrificial pattern material, wherein the assembling engages the first said stepped portion of the refractory metal core, with a mating surface of the die.

* * * * *